United States Patent [19]

Rehrer

[11] Patent Number: 4,460,380

[45] Date of Patent: Jul. 17, 1984

[54] WATER SHEDDING AGENTS IN DISTILLATE FUEL OILS

[75] Inventor: David H. Rehrer, Westfield, N.J.

[73] Assignee: Exxon Research & Engineering Co., Florham Park, N.J.

[21] Appl. No.: 453,235

[22] Filed: Dec. 27, 1982

[51] Int. Cl.[3] ..... C10L 1/28

[52] U.S. Cl. ..... 44/62; 44/76

[58] Field of Search ..... 44/62, 76

[56] References Cited

U.S. PATENT DOCUMENTS

| | | | |
|---|---|---|---|
| 2,862,885 | 12/1958 | Nelson et al. | 44/76 |
| 2,917,480 | 12/1959 | Bailey et al. | 260/42 |
| 3,048,479 | 8/1962 | Ilnyckyj et al. | 44/70 |
| 3,233,986 | 2/1966 | Morehouse | 44/76 |
| 3,762,888 | 10/1973 | Kober et al. | 44/62 |
| 3,764,282 | 10/1973 | Furlong | 44/76 |
| 3,961,916 | 6/1976 | Ilnyckyj et al. | 44/62 |
| 4,002,558 | 1/1977 | Feldman | 208/188 |
| 4,115,343 | 9/1978 | Guillaume | 260/33.6 SB |
| 4,211,534 | 7/1980 | Feldman | 44/62 |

FOREIGN PATENT DOCUMENTS

| | | |
|---|---|---|
| 1281108 | 7/1972 | United Kingdom . |
| 1360398 | 7/1974 | United Kingdom . |

*Primary Examiner*—Charles F. Warren
*Assistant Examiner*—Mrs. Y. Harris-Smith
*Attorney, Agent, or Firm*—F. T. Johmann

[57] ABSTRACT

Block polymers of organosiloxane and polyalkylene oxide are used in middle distillate petroleum fuel oils for separating out or otherwise reducing water haze in the oil. These block polymers are particularly useful in heating oils and diesel fuels, containing wax crystal modifier additives to improve the low temperature flow properties of the oil, particularly those modifiers which are copolymers of ethylene and an unsaturated ester and which have a tendency to stabilize and maintain the water haze in the oil.

5 Claims, No Drawings

WATER SHEDDING AGENTS IN DISTILLATE FUEL OILS

BACKGROUND OF THE INVENTION

1. Field of the Invention

This invention relates to clarifying and decreasing visible water haze in petroleum middle distillate oils, such as fuel oil or diesel fuel, by causing its separation by the addition of an antihaze agent comprising a polyorganosiloxane polymer having polymeric alkylene oxide units, such as a block copolymer of at least one block of dialkylsiloxane, e.g. dimethylsiloxane, units, with at least one block of ethylene oxide and/or propylene oxide units. The anti-haze agent may be added directly to the fuel oil or it may be incorporated in a concentrate of a wax crystal modifier comprising a copolymer of ethylene with an unsaturated ester, such as a copolymer of ethylene and vinyl acetate. These wax crystal modifiers have a tendency to stabilize the haze in the oil, which tendency can be offset by adding the dehazing agent to the conventional oil concentrate of the wax crystal modifier. By causing coalescing and separation of the water, i.e. water shedding, the water can collect in the usual refinery or bulk storage tanks as bottoms and subsequently be removed.

2. Description of Prior Disclosures

Water haze in oil is a well known problem, in that the water may later undesirably coalesce after it leaves the refinery in customer or terminal storage facilities to cause corrosion and operating problems, including ice formation, as well as being objectionable from a marketing standpoint because of its undesirable appearance.

U.S. Pat. No. 4,002,558 teaches a water-in-oil emulsion haze problem of middle distillate fuel oils which may further contain an ethylene-vinyl acetate wax crystal modifier or flow improver, and uses various inorganic salts to remove the haze.

U.K. Pat. No. 1,360,398 teaches organosiloxanes, such as dimethylsiloxane, having one or more blocks of alkylene oxide units, including the general type of block copolymer utilized in the present invention for use in any hydrocarbon oil, for example, a lubricating oil or cutting oil. However, there is no specific teaching of the middle distillate oils of the invention or the use in combination with a copolymer of ethylene and unsaturated ester wax crystal modifier, e.g. flow improving, additive.

U.K. Pat. No. 1,281,108 teaches polyoxyalkylenepolysiloxane mixed block polymers for breaking petroleum emulsions of the water-in-oil type.

U.S. Pat. No. 4,115,343 teaches a combination of mineral oil containing a copolymer of ethylene and vinyl acetate and an organosiloxane polymer, such as dimethylpolysiloxane, which combination is particularly useful as an antifoamant agent for lubricating oils.

U.S. Pat. No. 3,233,986 teaches as an antifoam agent for liquids, including gasoline, kerosene and diesel fuels, which may contain trace amounts of water, the addition of a block copolymer wherein at least one block contains siloxane groups and another block contains oxyalkylene groups, in amounts of 5 to 2,000 parts by weight of the antifoam block copolymer per million parts by weight of the organic liquid.

U.S. Pat. No. 2,917,480 teaches block copolymers having polysiloxane blocks with oxyalkylene blocks, as lubricants and mold release agents.

THE INVENTION

None of the above patents teach the present invention, wherein polyorganosiloxane derivatized with polyalkyleneoxide is used in middle distillate fuel oils to facilitate separating-out water haze, i.e. water shedding, particularly in fuel oils which have been treated with an ethylene-ester copolymer wax crystal modifier which otherwise tends to stabilize water-in-oil emulsions making the separation of water even more difficult.

The compositions of the invention will usually comprise a major amount of a middle distillate fuel oil and about 1 to 1000, e.g. 2 to 100, frequently 2 to 20, parts by weight of the polysiloxane/polyalkyleneoxide block copolymer per million parts by weight of fuel oil. The composition may also contain about 0.001 to 0.5 weight %, e.g. 0.01 to 0.1 weight % of an ethylene-ester copolymer flow improving polymer, based on the weight of the fuel oil. Concentrates comprising mineral oil as diluent, and 10 to 70 weight % of a copolymer of ethylene and unsaturated ester flow improver, may also include 0.1 to 15 weight % of the aforesaid block copolymer as a water shedding agent.

The Polysiloxane/Polyalkylene Oxide Block Copolymers

Block copolymers of the type described in U.K. Pat. Nos. 1,281,108 and 1,360,398 (which patents are hereby incorporated in their entirety) can be used. In general, useful copolymers will contain from about 2 to 2,000 silicon atoms and can be linear or branched and preferably have 2 to 500 silicon atoms per molecule and may contain 1 to 10 polymeric blocks of a organo siloxane, e.g. a dihydrocarbyl siloxane of the structure

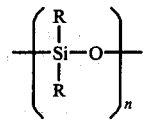

wherein R is an organo group of 1 to 8 carbons, preferably a hydrocarbyl group and most preferably a dimethylsiloxane, while n is the number of silicon atoms per siloxane block, for example, 2 to 2000 total silicon atoms as mentioned above, divided by the number of polymeric blocks of siloxane, e.g. 1 to 10. Attached to the polysiloxane unit or units may be from 1 to 10 blocks of alkylene oxide units which are either ethylene oxide and/or propylene oxide units such that the polyalkylene oxide units comprise about 10 to 90, usually 20 to 70 weight % of the total block copolymer, while the balance is polysiloxane. Some block structure which may be used include ABAB . . . ; BAB; ABA, BABA . . . ,

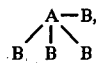

etc., where A represents the polysiloxane blocks and B represents the polyalkyleneoxide blocks. A specific material utilized in the examples of the present invention is Dow Corning® Q4-3667 fluid (hereinafter referred to as Additive A) which is a primary hydroxyl functional polydimethylsiloxanepolyoxyethylene copolymer supplied as 100% active fluid, having a linear structure with the hydroxy functionality only on the ends of the polymer chain. This material typically has a viscosity at 40° C. of 300 Centistokes, has 1.7 weight % of primary hydroxyl groups which correspond to two hydroxyl sites per molecule indicating a BAB type of block structure, giving an average hydroxyl equivalent molecular weight of 1200, and gives about 14.1 wt. % ash (i.e. Si) on combustion.

The Ethylene Copolymers

The ethylene copolymers are the type known in the art as wax crystal modifiers, e.g. pour depressants and cold flow improvers for distillate fuel oils and usually will comprise about 3 to 40, preferably 4 to 20 molar proportions of ethylene per molar proportion of an unsaturated ester. These polymers will generally have a number average molecular weight in the range of about 500 to 50,000 preferably about 800 to about 20,000, e.g. 1,000 to 6,000 as measured by Vapor Pressure Osmometry (VPO); such as by using a Mechrolab Vapor Pressure Osmometer Model 302B. The preferred mono-unsaturated ester monomers are monomers containing a total of about 3 to 20, usually 4 to 12, carbon atoms and may be mono and diesters of the general formula:

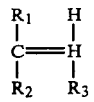

wherein $R_1$ is hydrogen or methyl; $R_2$ is a —$OOCR_4$ or —$COOR_4$ group wherein $R_4$ is hydrogen or $C_1$ to $C_8$, e.g. $C_1$ to $C_4$ straight or branched chain alkyl group; and $R_3$ is hydrogen or —$COOR_4$. Examples of such esters include vinyl acetate, vinyl isobutyrate, methyl acrylate, isobutyl acrylate, 2-ethylhexyl acrylate, methyl methacrylate, mono-isobutyl fumarate, diisobutyl fumarate, di-isopropyl maleate, ethyl methyl fumarate, etc. It is preferred, however, that the acid groups be completely esterified, as free acid groups especially tend to promote haze if moisture is present in the oil. Wax crystal modifier materials of the above type are well known in the art and have been frequently described, for example in U.S. Pat. No. 4,211,534.

While these ethylene-ester copolymers, particularly copolymers of ethylene and vinyl acetate, are frequently used alone in the distillate fuel or in an additive concentrate, they may be used in combinations with 0.1 to 10 parts by weight of one or more of a non-ethylene containing auxiliary wax crystal modifying additive per one part by weight of said copolymer of ethylene and unsaturated ester. Said auxiliary wax crystal modifier includes non-ethylene polymers, particularly polymers generally considered as lubricating oil pour depressants such as homopolymers and copolymers comprising moieties of $C_{10}$ to $C_{26}$ mono-alpha olefins, $C_{10}$ to $C_{26}$ unsaturated alkyl esters, including copolymers with other unsaturated monomers, e.g. nitrogen-containing monomers. Usually in these lubricating oil pour depressants about 50 wt. % or more of the polymer will be in the form of straight chain $C_8$ to $C_{24}$, e.g. $C_8$ to $C_{16}$ alkyl groups of an alpha olefin or an ester, for example, the alkyl portion of an alcohol used to esterify a mono or dicarboxylic acid, or anhydride. Examples of such lubricating oil pour depressants include: homopolymer of n-hexadecyl acrylate; copolymer of n-hexadecyl acrylate and methyl acrylate; n-hexadecyl acrylate copolymerized with docosanyl acrylate; copolymers of vinyl acetate and dialkyl fumarate; etc.

The ethylene-unsaturated ester copolymers may also be used with various nitrogen compounds known as auxiliary wax crystal modifying additives, such as oil-soluble amine salts and/or amides, formed by reaction of at least one molar proportion of hydrocarbyl substituted amines with a molar proportion of hydrocarbyl carboxylic acid having 1 to 4 carboxylic, preferably dicarboxylic acid groups or their anhydrides. Particularly useful nitrogen compounds are the salts and/or amides of maleic anhydride and phthalic anhydride with long chain amines, especially the ditallow amine which is secondary amine derived from hydrogenated tallow acids wherein the alkyl groups are $C_{16}$ to $C_{18}$ straight chain alkyl groups. Nitrogen compounds of this type, as well as the lubricating oil pour depressant polymers, are described in further detail in U.S. Pat. No. 4,211,534 (which is hereby incorporated in its entirety into the present specification). Still other additives that can be included with the ethylene-unsaturated ester copolymer are various other additives such as viscosity modifiers, chlorinated wax-naphthalene condensation products useful as fuel or lubricating oil pour depressants, and bulky compounds with long straight chains, e.g. saturated fatty acid ester of polyhydric alcohols such as Sorbitol, polyglycols, etc. as described in U.S. Pat. No. 3,762,888.

The Distillate Fuels

The distillate fuel oils will generally boil within the range of about 120° C. to about 500° C., e.g. 150° to about 400° C. The fuel oil can comprise atmospheric distillate or vacuum distillate, or cracked gas oil or a blend in any proportion of straight run and thermally and/or catalytically cracked distillates, etc. The most common petroleum distillate fuels are kerosene, jet fuels, diesel fuels and heating oils. The heating oil may be a straight atmospheric distillate, or it may frequently contain minor amounts, e.g. 0 to 35 wt. %, of vacuum gas oil and/or of cracked gas oils. The low temperature flow problem is most usually encountered with diesel fuels and with heating oils.

The final composition of the invention will generally comprise a major amount of the distillate fuel and about 0.0001 to 0.1, preferably 0.0002 to 0.01 wt. % of the silioxane copolymer. The fuel may also contain about 0.001 to 0.2 wt. %, preferably 0.005 to 0.10 wt. % of the aforedescribed oil soluble ethylene-unsaturated ester flow improvers. The oil may further contain about 0.002 to 0.40, preferably 0.005 to 0.20 wt. % total of various auxiliary wax crystal modifying substances in any proportion or mixture, including the aforesaid lubricating oil polymeric pour depressants, the oil-soluble nitrogen compounds, various esters such as $C_{10}$ to $C_{30}$ straight chain fatty acid esters of polyhydric materials such as Sorbitol, polyethylene glycols, etc. wherein said weight percents are based on the weight of the total composition.

The invention will be further understood by reference to the following Examples which include preferred embodiments of the invention.

EXAMPLE I

In carrying out the Example, the following materials were used:

Additive A was a block copolymer of polyethylene oxide and polydimethylsiloxane available from Dow- Corning Corporation, Midland, Mich. as Q4-3667 as described.

Polymer 1 was a concentrate in about 55 wt. % of heavy aromatic naphtha mineral oil as solvent, of about 45 wt. % of a mixture of two ethylene-vinyl acetate copolymers, having different oil solubilities, so that one functions primarily as a wax growth arrestor and the other as a nucleator, in accord with the teachings of U.S. Pat. No. 3,961,916 which patent is hereby incorporated herein in its entirety. Said polymer mixture consisted of about 75 wt. % of copolymer essentially of about 62 wt. % ethylene and about 38 wt. % vinyl acetate, having a number average molecular weight of about 1800 (VPO) (identified in said U.S. Pat. No. 3,961,916 as Copolymer B of Example 1 (column 8, lines 25–35)) and about 25 wt. % of a copolymer consisting essentially of about 84 wt. % ethylene and about 16 wt. % vinyl acetate, having a number average molecular weight of about 3000 (VPO) (identified in said U.S. Pat. No. 3,961,916 as Copolymer H in Table I, column 7–8).

Fuel Oil A and Fuel Oil B were both middle distillate fuel oils having the following characteristics summarized in Table I.

TABLE I

| Distillation (ASTM D-86) | Fuel A | Fuel B |
|---|---|---|
| IBP (Initial Boiling Point) | 172° C. | 168° C. |
| 20% Distillation Point | 236° C. | 206° C. |
| 95% Distillation Point | 382° C. | 330° C. |
| FBP (Final Boiling Point) | 392° C. | 341° C. |
| WAT, °C. (Wax Appearance Temperature) | 2.7 | −10.5 |
| Cloud Point, °C. | 6 | −8 |
| Specific Gravity, API | 0.8407 | 0.8368 |
| Aromatics, wt. % | 26.6 | 26.2 |
| ASTM Color | L2.0 | L1.0 |
| Wax Content @ 5° C. Below WAT, wt. % | 0.75 | 1.95 |

Dehazing, i.e. water shedding, tests were carried out on a series of blends prepared by adding 1000 ml of the fuel oil into a 1000 ml. cylindrical graduate, adding 500, 1000, or 2000 ppm of Polymer 1, or 10 ppm of Additive A, and then 10 milliliters (1.0 wt. %) of added distilled water. This was followed by initial shaking of the graduate to mix the added materials, and then pouring the graduate contents into a Waring blender where they were mixed for two minutes at 10,000 rpm. The mixture was then poured back into the 1,000 ml. graduate and stored quiescently at room temperature (i.e. temperature of about 75±5° F.). At periodic intervals, a 20 ml. sample was drawn, without mixing or disturbing the bottom water layer that may be forming, from the midpoint of the graduate using a pipette. The sample was tested in a Spectronic 20 Spectrophotometer manufactured by Bausch and Lomb. The instrument was calibrated to 100% transmission with a sample of base fuel oil.

The blends prepared and the results obtained are summarized in Table II.

TABLE II

| % Light Transmittance - Fuel A + 1.0 wt. % Added Water | | | | | | | | | |
|---|---|---|---|---|---|---|---|---|---|
| | Test Hours | | | | | | | | |
| Additive | 0 | 2 | 24 | 48 | 96 | 192 | 264 | 504 | 672 |
| None | 1 | 1 | 10 | 25 | 42 | 55 | 61 | 77 | 78 |
| 500 ppm Polymer 1 | 1 | 1 | 3 | 6 | 18 | 31 | 53 | 82 | 83 |
| 1000 ppm Polymer 1 | 1 | 1 | 2 | 4 | 20 | 63 | 82 | 93 | 94 |
| 2000 ppm Polymer 1 | 1 | 1 | 1 | 2 | 11 | 68 | 83 | 95 | 97 |

TABLE II-continued

| % Light Transmittance - Fuel A + 1.0 wt. % Added Water | | | | | | | | | |
|---|---|---|---|---|---|---|---|---|---|
| | Test Hours | | | | | | | | |
| Additive | 0 | 2 | 24 | 48 | 96 | 192 | 264 | 504 | 672 |
| 10 ppm Additive A | 13 | 36 | 65 | 73 | 84 | 96 | 96 | 98 | 99 |

As seen by Table II, the fuel per se with the 1.0 wt. % added water, after 672 hours (4 weeks) standing at room temperature of about 74° F.±2° F. still passed only 78% of the light as opposed to a standard of 100% for Fuel A per se before any water had been added and mixed. It is thus seen that water in the fuel can be stable for extended periods of time imparting a hazy appearance to the fuel since the haze is visible to the naked eye at a light transmission below about 90%. It is also seen that adding 500 parts per million of Polymer 1, i.e. 225 ppm of actual ethylene-vinyl acetate (EVA) cold flow improving copolymer, that between the 24 and 96 hour test interval Polymer 1 had increased the stability of the haze as indicated by the lower light transmittance as compared to no polymer. If Polymer 1 had been used to treat the moisture containing oil at a refining or distribution terminal, and then shipped to a customer in a day or so after treatment, the customer would see a very hazy oil that would tend to persist. While the haze in the Polymer 1 treated oil had substantially cleared after 504 hours of standing as the water coalesced and settled to the bottom of the graduate, in commercial operation, the oil could have been shipped to a customer in a hazy condition well before this extended settling period of 504 hours occurred. While the action of these ester-containing copolymers on the water haze is not known with certainty, it is believed that water molecules are being attracted to the ester portions of the oil-soluble polymer which initially tends to impede the settling-out or separation of the water. As more and more water molecules gather around these polar ester groups, the water molecules may then begin to coalesce together and finally begin to settle-out in the bottom of the graduate. The addition of the 10 parts per million by weight of Additive A resulted in a very rapid clearing of the moist fuel as noted from the instant that the sample was removed from the Waring blender and measured for light transmission. Upon the extended standing time of 192 hours this sample was visually clear.

While Table II summarizes the individual effects of: water causing haze in oil, the initial haze stabilizing effect of the ethylene-vinyl acetate (EVA) copolymers conventionally used to treat fuel oil, and the effect of Additive A on the moist oil, the following Example 2 demonstrates the effect of Additive A added to the moist oil containing the EVA copolymer.

EXAMPLE 2

Following the method of Example 1, a series of oil blends were made up in Fuel A containing 500 ppm of Polymer 1 to which were added either 10 parts per million of Additive A or various other types of anti-emulsion or antifoam agents. Briefly described, these other agents are as follows:

Additive B. A silicone glycol copolymer surfactant (100% a.i.) believed to be a dialkylsilicone wherein the alkyl groups are methyl having a viscosity at 77° F. of about 1500 centistokes.

Additive C. This is a de-emulsifying agent commercially available for breaking oil-in-water emulsions and is an oxyalkylated amine and ester of oxyalkylated resin in hydrocarbon solvent.

Additive D. This is a de-emulsifying agent commercially available for breaking oil-in-water emulsions and is a glycol ester in hydrocarbon solvents.

Additive E. This is a polyol ester type demulsifier.

Additive F. This is a de-emulsifying agent commercially available for breaking oil-in-water emulsions and is a fatty acid ester of polyene glycol in aromatic solvent.

Additive G. This is a polyol of propylene glycol, propylene oxide, and ethylene oxide with a polyoxypropylene molecular weight of 2280 and 10 wt. % of polyoxyethylene in the total molecule (according to the manufacturer).

Additives A to G were added at a level of 10 parts per million of active ingredient to Fuel Oil A containing 1.0 wt. % of added water and 500 ppm of Polymer 1. The resulting blends were then tested for light transmittance by withdrawing test samples at the mid-point of the 1,000 ml. graduate after standing for periods of 24, 96, 264, and 504 hours. The results are given in Table III, along with readings on the fuel oil A containing the Polymer 1 without any additional additive.

TABLE III

| Additive (10 ppm) | % Light Transmittance - Fuel A + 1.0 Wt. % Added Water + 500 ppm Polymer 1 — Test Hours 0 | 2 | 24 | 48 | 96 | 192 | 264 | 504 | 672 |
|---|---|---|---|---|---|---|---|---|---|
| No Water Shedding Agent | 1 | 1 | 3 | 6 | 18 | 31 | 53 | 82 | 83 |
| A | 13 | 36 | 65 | 73 | 84 | 96 | 96 | 98 | 99 |
| B | 1 | 2 | 18 | 34 | 39 | 51 | 56 | 74 | 78 |
| C | 1 | 1 | 4 | 5 | 25 | 49 | 52 | 68 | 72 |
| D | 1 | 2 | 3 | 6 | 20 | 32 | 36 | 56 | 62 |
| E | 1 | 1 | 3 | 4 | 13 | 30 | 33 | 51 | 58 |
| F | 1 | 2 | 5 | 6 | 12 | 20 | 27 | 42 | 50 |
| G | 1 | 1 | 4 | 4 | 11 | 16 | 18 | 29 | 35 |

As seen from Table III above, the effectiveness of Additive A, the block copolymer of polysiloxane and ethylene oxide, was much superior to the other types of de-emulsifying or anti-foaming agents that were tried. In fact, most were not much better than No Water Shedding Agent present in the fuel containing the 500 ppm of Polymer 1 which at the 192 hour level showed a light transmission of only 31%. On the other hand, with the sample containing Additive A, the light transmission was already 96% at 192 hours thereby indicating a very substantial clearing of the haze and settling out of the water to the bottom of the graduate. The other materials (B through G) tested seemed to give little improvement in the clarity of the oil even though they are commercially available for resolving oil-in-water emulsions and could have been expected to show effectiveness in Fuel A containing Polymer 1.

EXAMPLE 3

Example 3 was carried out in a similar manner to that of Examples 1 and 2 using Fuel A containing 500 ppm Polymer 1 to which were added respectively 5, 10 and 25 ppm of Additive A, followed by testing for light transmission in the manner previously described. The results follow:

TABLE IV

| Additive A | % Light Transmittance - Fuel A + 1.0 Wt. % Water + 500 ppm Polymer 1 — Test Hours 0 | 24 | 96 | 336 |
|---|---|---|---|---|
| None | 1 | 10 | 42 | — |
| 5 ppm | — | 61 | 81 | 99 |
| 10 ppm | — | 63 | 88 | 99 |
| 25 ppm | — | 67 | 88 | 99 |

As seen by Table IV above, Additive A was essentially as effective at the 5 ppm level at 336 hours as was the use of the higher concentrations of 10 ppm and 25 ppm. This thus demonstrates the extreme effectiveness of very small amounts of this additive.

EXAMPLE 4

This example was carried out in a manner similar to that of Examples 1 to 3 above, except that the base oil consisted of Fuel B containing 500 parts per million of Polymer 1 and 1.0 wt. % of added distilled water, to which was added 10 parts per million of Additive A. The resulting blend was then tested for light transmission as previously described. The results are summarized in the following Table V:

TABLE V

| Additive | % Light Transmittance - Fuel B + 1.0 Wt. % Water — Test Hours 0 | 2 | 24 | 48 | 96 | 168 |
|---|---|---|---|---|---|---|
| None | 3 | 19 | 81 | 92 | 97 | 100 |
| 500 ppm Polymer 1 | 2 | 6 | 56 | 80 | 95 | 100 |
| 500 ppm Polymer 1 + 10 ppm Additive A | 22 | 55 | 84 | 94 | 98 | 100 |

As seen by Table V above, 10 ppm of Additive A was extremely effective in improving the haze between 0 and 48 hours. At the end of 96 hours and 168 hours there is little difference between the samples. However, the time required to achieve a light transmission value of greater than 90% was substantially reduced.

EXAMPLE 5

This example was carried out in a manner similar to that of the preceding examples, using Fuel A with 1.0 wt. % added water with 500 ppm of Polymer 1 and varying amounts of either Additive A, or other additives as indicated. The results are summarized in Table VI.

TABLE VI

| Additive | % Light Transmission - Fuel A + 1.0% Added Water — Test Hours 0 | 2 | 24 | 48 | 96 | 168 | 336 |
|---|---|---|---|---|---|---|---|
| None | 1 | 1 | 19 | 31 | 41 | 50 | 64 |
| 500 ppm Polymer 1 + 40 ppm C | 1 | 1 | 6 | 19 | 24 | 28 | 37 |
| 500 ppm Polymer 1 + 60 ppm D | 1 | 2 | 4 | 6 | 12 | 16 | 26 |
| 500 ppm Polymer 1 + 30 ppm F | 2 | 2 | 6 | 9 | 19 | 25 | 44 |
| 500 ppm Polymer 1 + 5 ppm A | 8 | 23 | 63 | 78 | 89 | 98 | 96 |
| 500 ppm Polymer 1 + 10 ppm A | 19 | 41 | 67 | 78 | 89 | 97 | 99 |
| 500 ppm Polymer 1 + 25 ppm A | 21 | 41 | 61 | 71 | 81 | 92 | 99 |

As seen by Table VI, the invention, represented by the use of Additive A gave good results with a rapid and high degree of water-shedding indicated by the clearing of the haze, while the comparative Additives C, D and F showed poor water shedding and persistance of haze.

What is claimed is:

1. A petroleum fuel oil comprising a major proportion of a distillate oil boiling in the range of about 120° to 500° C., about 0.001 to 0.5 weight %, based on the weight of said oil, of a wax crystal modifier which is a copolymer of ethylene and a monoethylenically unsaturated ester having a total of 3 to 20 carbon atoms, said ethylene copolymer having a number average molecular weight in the range of about 500 to 50,000 and a relative molar ratio of about 3 to 40 molar proportions of ethylene per molar proportion of said unsaturated ester; and about 0.0001 to 0.1 weight %, based on the weight of the oil, of a dehazing agent which is a block copolymer comprising at least one block of dihydrocarbyl siloxane units and at least one block of a polyoxyalkylene oxide, wherein said hydrocarbyl groups contain 1 to 8 carbons each, said alkylene groups contain 2 or 3 carbon atoms, said polymer consisting essentially of about 10 to 90 weight % of polyoxyalkylene units and about 90 to 10 weight % of said dihydrocarbyl siloxane units, and the number of silicon atoms per average molecule ranges from about 2 to 2000.

2. A method of inhibiting haze in a petroleum fuel oil which contains about 0.001 to 0.5 weight %, based on the weight of said oil, of a wax crystal modifier which is a copolymer of ethylene and a monoethylenically unsaturated ester having a total of 3 to 20 carbon atoms, said ethylene copolymer having a number average molecular weight in the range of about 500 to 50,000 and a relative molar ratio of about 3 to 40 molar proportions of ethylene per molar proportion of said unsaturated ester, by the addition thereto of about 0.0001 to 0.1 weight %, based upon the weight of said oil, of an antihaze agent comprising a block copolymer having at least one block consisting essentially of one to 10 blocks of dihydrocarbyl siloxane units wherein the hydrocarbyl groups are 1 to 8 carbon atoms each, and one to ten blocks consisting essentially of alkylene oxide units of 2 to 3 carbon atoms, wherein said block copolymer comprises about 10 to 90 weight % of siloxane units and about 90 to 10 weight % of alkylene oxide units, and wherein the average number of silicon atoms per polymer molecule is about 2 to 2000.

3. A composition according to claim 9, wherein said dehazing agent has two blocks of (B) polyalkyleneoxide units terminating in hydroxyl groups attached to a single block (A) of said polysiloxane to form a B-A-B type block copolymer.

4. A composition according to claim 9 wherein said ethylene copolymer is a copolymer of 3 to 40 molar proportions of ethylene per molar proportion of vinyl acetate having a number average molecular weight in the range of about 1,000 to 6,000.

5. A fuel oil according to claim 4 wherein said antihaze agent is a block copolymer of a dimethylsiloxane block terminating in polyethyleneoxide blocks having hydroxyl functionality.

* * * * *